US006793587B2

(12) United States Patent
Llewellyn et al.

(10) Patent No.: US 6,793,587 B2
(45) Date of Patent: Sep. 21, 2004

(54) TRIAL GOLF CLUB, GOLF CLUB FITTING SYSTEM AND METHODS OF USING THE SAME

(75) Inventors: David G. Llewellyn, Duluth, GA (US); William A. Price, Jr., Roswell, GA (US); Masao Nagai, Suwanee, GA (US)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/209,677

(22) Filed: Jul. 31, 2002

(65) Prior Publication Data

US 2004/0023725 A1 Feb. 5, 2004

(51) Int. Cl.[7] ..... A63B 53/06; A63B 53/16; A63B 69/36; A63B 53/04; A63B 53/08

(52) U.S. Cl. ..... 473/242; 473/324; 473/407

(58) Field of Search ..... 473/244, 245, 473/246, 248, 253, 252, 407, 409, 559, 560, 242, 294, 201, 204; 33/508

(56) References Cited

U.S. PATENT DOCUMENTS 4,231,576 A * 11/1980 Perkins ..... 473/242
5,120,061 A * 6/1992 Tsuchida et al. ..... 473/305
5,469,627 A 11/1995 Denny et al.
5,513,844 A 5/1996 Ashcraft et al.
5,722,177 A 3/1998 Reilly, III
5,782,005 A 7/1998 Reilly, III
5,864,960 A 2/1999 DeNicolo et al.
5,865,684 A * 2/1999 Herber ..... 473/201
5,911,636 A 6/1999 Schmoll
5,976,031 A 11/1999 Johnson
6,041,651 A * 3/2000 Naruo et al. ..... 73/491
6,083,123 A * 7/2000 Wood ..... 473/409
D445,862 S * 7/2001 Ford ..... D21/747
6,280,348 B1 8/2001 Stites
6,328,660 B1 12/2001 Bunn, III
6,364,789 B1 4/2002 Kosmatka
6,368,230 B1 4/2002 Helmstetter et al.
6,405,450 B1 * 6/2002 Wood et al. ..... 33/759
6,471,599 B2 * 10/2002 Ford ..... 473/242

* cited by examiner

*Primary Examiner*—Stephen P. Garbe
*Assistant Examiner*—Alvin A. Hunter, Jr.
(74) *Attorney, Agent, or Firm*—Troutman Sanders LLP; Gerald R. Boss

(57) ABSTRACT

A trial golf club and golf fitting system for determining at least one custom fitted golf club. The trial club includes a golf club head having a sole defined by a radius of curvature. The sole of the golf club head includes graduated indicia for identifying an optimal lie angle for the fitted club. When the golfer swings the trial golf club, the optimal lie angle of the fitted club is identified by locating the point of impact on the sole of the head of the trial golf club.

16 Claims, 5 Drawing Sheets

TRIAL GOLF CLUB, GOLF CLUB FITTING SYSTEM AND METHODS OF USING THE SAME

TECHNICAL FIELD

The present invention relates to golf club fitting systems and, more specifically, to a trial golf club used to determine a fitted set of golf clubs.

BACKGROUND OF THE INVENTION

Every golfer desires to optimize their golf swing. However, every golfer's swing is different and, therefore, every golfer requires a set of golf clubs which compensates best matches his swing. Each golfer's swing requires a certain geometry for his golf clubs, but it is difficult to determine the ideal club geometry for each golfer. Typically, in order to determine the ideal club geometry for a particular golfer, the length of the shaft of a set of golf clubs is custom fitted to the golfer. Also, each golfer should be fitted to determine his ideal lie angle.

Currently, there is a wide variety of golf club fitting systems available for determining which particular set of golf clubs should be used by a golfer. Most known golf club fitting systems utilize a golf club which has been significantly modified by including mechanical features which identify or adjust the golfer's swing. Often these additional mechanical features preclude these known golf clubs from being routinely used. These special features impair the performance of the club which prevents the golfer from accurately determining which set of golf clubs is right for him.

Therefore, there is a need for an improved golf fitting system which more easily determines the proper club geometry for many different users. The new golf club fitting system must not incorporate cumbersome or expensive features while still permitting the golfer to swing a golf club in an unobstructed manner to determine the most appropriate set of golf clubs for him.

SUMMARY OF THE INVENTION

The present invention solves the above-identified problems by providing a trial golf club to be utilized in an improved golf fitting system. The trial golf club and golf fitting system of the present invention are more easily utilized than other known trial golf clubs and golf fitting systems.

Generally described, one embodiment of the trial golf club of the present invention includes a golf club head having a sole defined by a radius of curvature. The club head also has graduated indicia on its sole. The indicia corresponds with a range of possible lie angles for a fitted golf club. When a golfer swings the trial golf club to contact a golf ball, the optimal lie angle for the fitted club can be identified by locating the point of impact of the sole of the golf club head with the ground.

In other aspects of the present invention, the trial golf club of the present invention may include additional features, or may be utilized in combination with other procedures, for determining the correct club geometry for any particular golfer.

The foregoing has broadly outlined some of the more pertinent aspects and features of the present invention. These should be construed to be merely illustrative of some of the more prominent features and applications of the invention.

Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
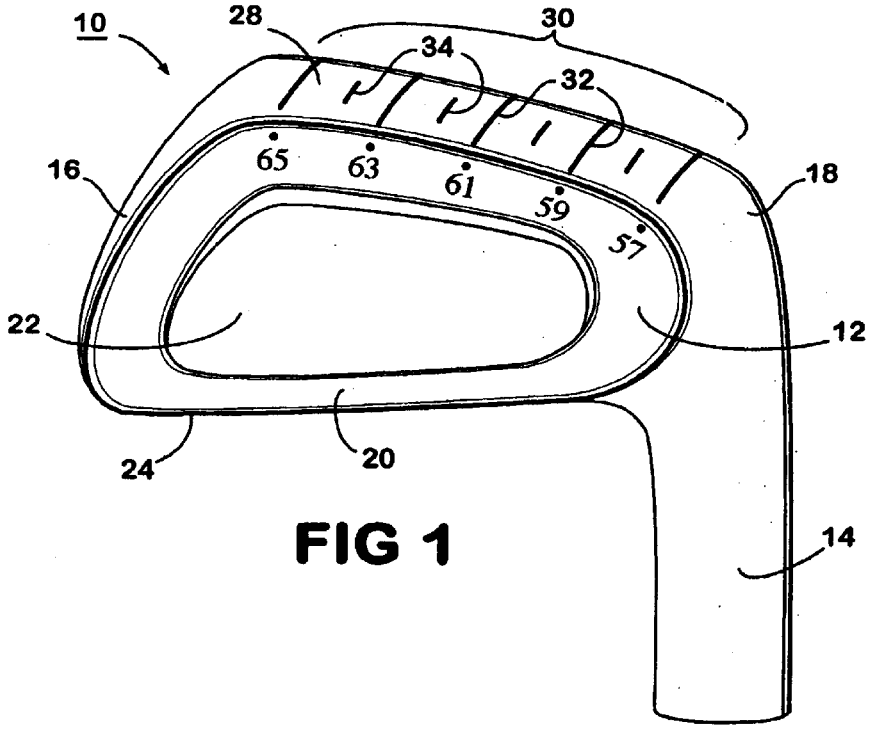
FIG. 1 is a perspective view of one embodiment of the club head of the golf fitting system of the present invention.

Referring now to the drawings in which like numerals indicate like elements throughout the several views, FIG. 1 depicts one embodiment of a golf club head 10 of the present invention. The golf club head 10 is preferably used as part of a trial golf club particularly adapted for fitting golfers with a set of custom golf clubs. The manner in which the golfer swings the trial golf club determines the proper lie and length for a set of custom golf clubs for the golfer.

The golf club head 10 includes a solid metal body 12 having an outwardly extending hosel 14 for receiving one end of an elongated shaft (not shown). The body 12 also includes a toe 16 opposite and taller in height than a heel 18. Interposed between the toe 16 and the heel 18 is the face and the back 20 of the club head 10. The back 20 typically includes a single large open cavity 22 extending toward the face. However, those skilled in the art will recognize that the back 20 may be otherwise free of the cavity 22 without departing from the scope of the present invention.

As best shown in FIG. 1, the body 12 also includes a crown 24 and a sole 28. The sole 28 of the golf club head 10 is defined by a radius of curvature in the range of approximately 350 mm to approximately 450 mm. Preferably, the golf club head 10 has a radius of curvature of approximately 400 mm. The sole 28 of the body 12 includes indicia 30 for identifying an optimal lie angle as explained in greater detail below. The indicia 30 reflects degrees of adjustment to the optimal lie angle desired for a custom fitted golf club. The indicia 30 preferably extends from the toe 16 to the heel 18 of the golf club head 10 as shown in FIG. 1.

The indicia 30 is preferably a plurality of markings spaced equidistant apart from one another. More preferably, at least a portion of similarly configured marking are spaced approximately 0.5 inches apart from one another and each identifies a particular lie angle. For example, the indicia 30 in FIG. 1 includes a set of long graduated score lines 32 and a set of short graduated score lines 34 which are interposed with one another. As explained above, the preferred radius of curvature is approximately 400 mm. Therefore, because there is a direct correlation with the radius of curvature of the golf club head 10, adjacent long score lines 32 are preferably spaced approximately 0.5 inches apart from one another and identify consecutive lie angles in two degree increments. In the event a different radius of curvature is selected, the indicia would then reflect the lie angles differently.

As shown in FIG. 1, the long score lines 32 identify lie angles of 57 degrees through 65 degrees in two degree increments. Preferably, the lie angles are identified on the edge of the back 20 adjacent the sole 28. The short score lines 34 may be used in combination with the long score lines 32 to determine lie angles in one degree increments.

Figure 2:
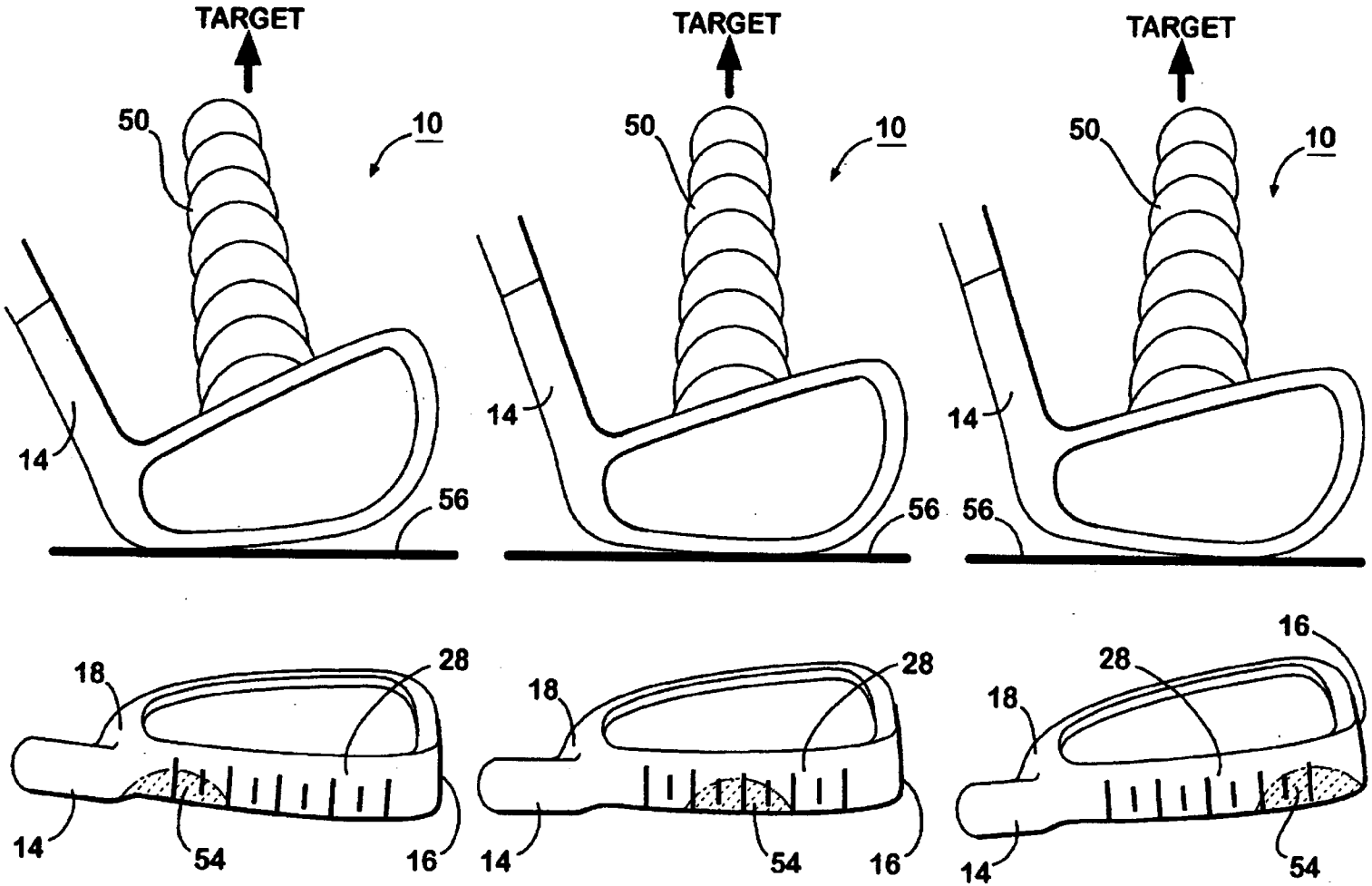
FIG. 2 is a view of possible lie angles and the resulting points of impact on a sole of the club head of FIG. 1.

The ability of the golfer to strike a golf ball consistently on the sweet spot is dependent upon the custom fitted clubs having the proper lie angle. A golfer can determine his correct lie angle by swinging the trial club having the club head 10. As best shown in FIG. 2, a golf ball 50 may land far to the left or right of where intended when the lie angle is incorrect. Only when the lie angle is correct, as shown in the center of FIG. 2, will the golf ball 50 land where it was intended to land.

Still referring to FIG. 2, when swinging the club head 10 of the present invention as to contact a golf ball, the lie angle number of the indicia 30 closest to the center of the point of impact 54 will reflect the lie angle. When the lie angle is too upright, as shown on the left side of FIG. 2, the point of impact 54 is adjacent the heel 18 of the club head 10. On the other hand, when the lie angle is too flat, as shown on the right side of FIG. 2, the point of impact 54 is adjacent the toe 16 of the club head 10. Preferably, however, when the lie angle is correct, as shown in the center of FIG. 2, the point of impact 54 is substantially evenly spaced between the toe 16 and the heel 18. Commonly available impact tape (not shown) adhesively secured to the sole 28 may make the point of impact 54 easier to view. Also, the point of impact 54 may be easier to view by utilizing a common lie board 56 as shown in FIG. 2.

Figure 3:
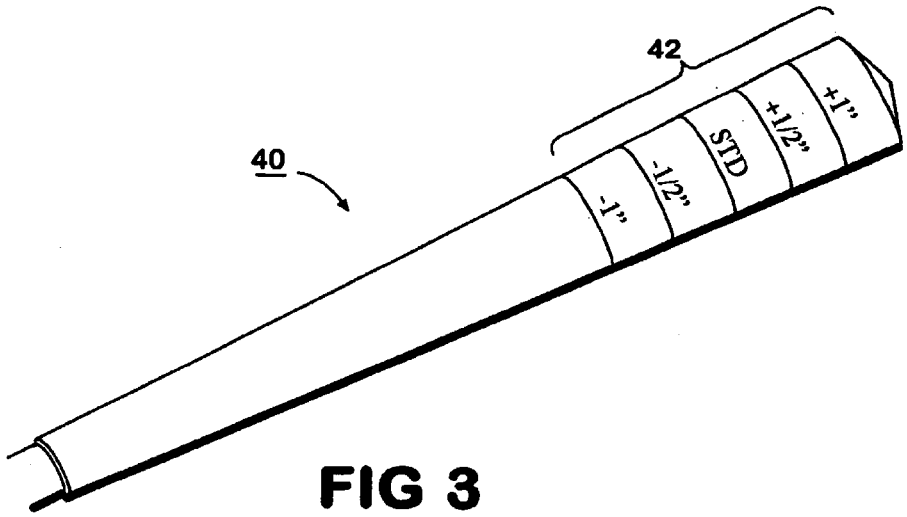
FIG. 3 is a perspective view of one embodiment of the golf club grip of the golf fitting system of the present invention.

A trial golf club utilizing the golf club head 10 of the present invention may also include an elongated grip 40 as shown in FIG. 3. The grip 40 is for mounting to the shaft of the trial golf club and may be of single piece polyurethane or like construction, as shown in FIG. 3, or alternatively a resilient strip which is spirally wrapped about the shaft. Those skilled in the art will recognize that the grip 40 may also include other alternative embodiments capable of providing a secure and cushioned grip without departing from the scope of the present invention.

The ability of the golfer to strike a golf ball consistently on the sweet spot is also a determining factor when deciding on the desired length of the shaft of the fitted club. Thus, the grip 40 includes graduated indicia 42 along a portion of its length for facilitating the identification of the optimal length of the custom fitted club. As shown in FIG. 3, the indicia 42 includes equally spaced markings in approximate 0.5 inch increments. Alternatively, the markings identify a range of possible shaft lengths from approximately 36.25 inches to approximately 38.25 inches. The optimal shaft length identified by using the grip 40 with the indicia 42 is used to select the length of a custom fit 6-iron. The remaining clubs in the set of custom fit clubs are then determined by increasing or decreasing the optimal length of the shaft by a fixed incremental amount. However, the amount which the shaft length of each iron is incremented is dependent upon the manufacturer.

Figure 4:
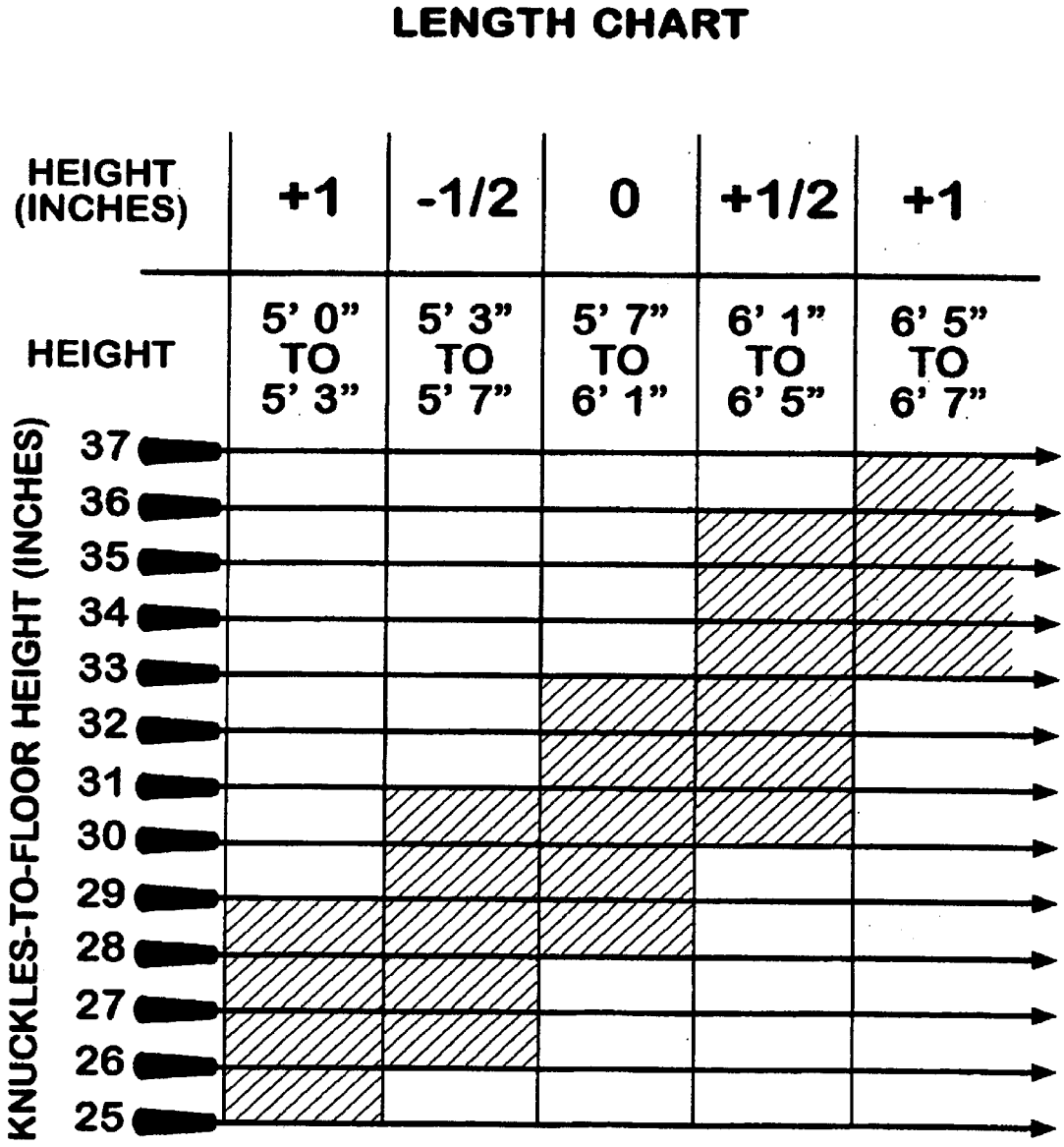
FIG. 4 is a shaft length chart for determining the optimal shaft length of a custom fitted golf club which may be used as an alternative to determining the optimal shaft length with the grip of FIG. 3.
Figure 5:
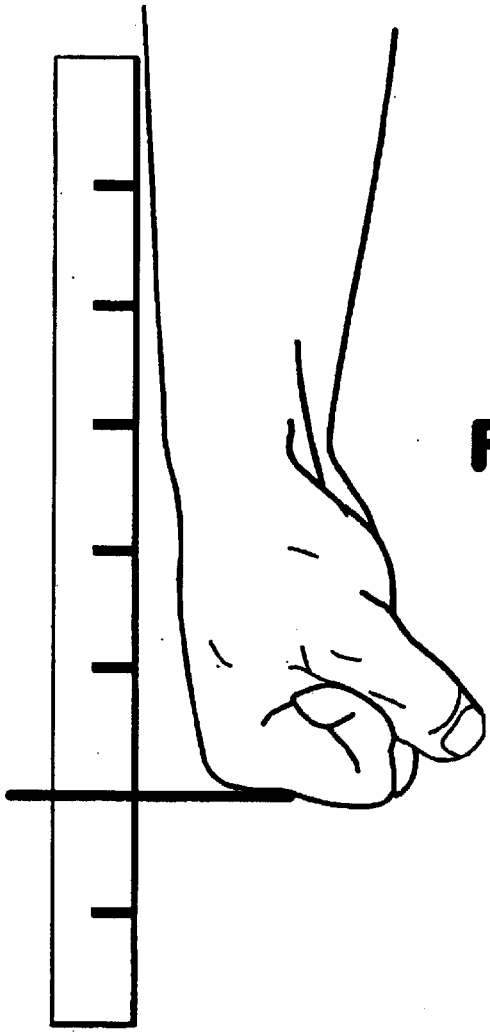
FIG. 5 depicts the manner in which a knuckles-to-floor height is determined for use with the length chart of FIG. 4.

The optimal shaft length for the custom fitted club may also be determined by using the length chart of FIG. 4 in conjunction with FIG. 5. While wearing street shoes or soft spike golf shoes, the golfer should stand substantially upright with his arms relaxed at his side. While making his hand into a fist, the distance from the ground to the knuckles of the fist is measured as shown in FIG. 5. Once the knuckles-to-floor measurement is determined, the knuckles-to-floor measurement is used, along with the height of the golfer, to determine the optimal shaft length for a fitted 6-iron from the length chart of FIG. 4. For example, a golfer who is approximately five feet and four inches in height and having a knuckles-to-floor measurement of approximately thirty inches would have an optimal 6-iron club length of approximately 36.5 inches. Typically, the standard shaft length is approximately 37 inches. However, by utilizing the length chart of FIG. 4, 0.5 inches was deducted from 37 inches resulting in the optimal club length of 36.5 inches for the 6-iron fitted to this golfer. As explained above, the remaining clubs in a set of custom fitted golf clubs are then determined by increasing or decreasing the optimal length of the shaft by a fixed incremental amount.

Figure 6:
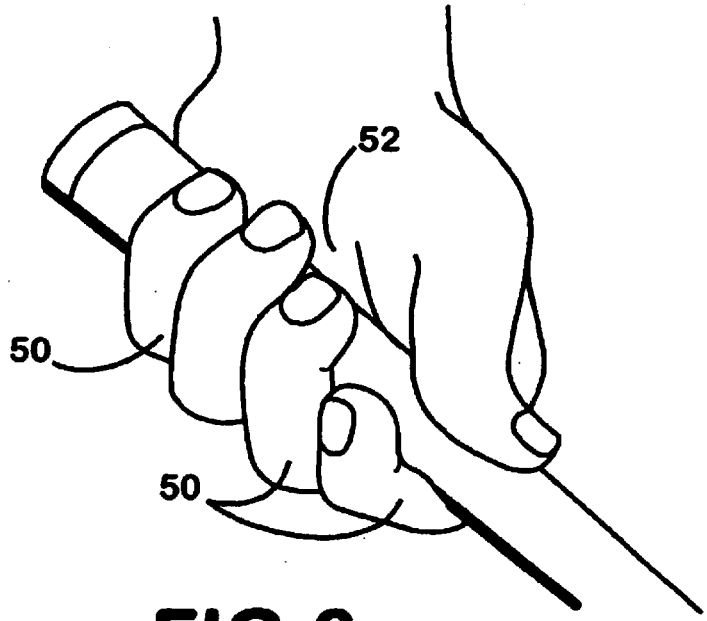
FIG. 6 is a perspective view of a properly fitted grip in the hand of a golfer.

A golfer's swing may also be affected by his grip size selection. Physical limitations such as arthritis, joint problems, carpal tunnel syndrome and long finger nails affect the grip size selection. As best shown in FIG. 6, a properly fitted grip can be determined by assessing the extent which the two middle fingers 50 touch the heel portion 52 of the palm of the golfer's hand. If the tips of the fingers 50 do not touch the heel portion 52 of the hand, the grip is too large. If the tips of the fingers 50 dig into the heel portion 52 of the hand, the grip is too small. If the tips of the fingers 50 barely touch the heel portion 52 as shown in FIG. 6, the grip size is correct.

A golfer's swing is also dependent upon the flex of the shaft. The club head speed, also commonly referred to as the swing speed, may be measured by a swing speed analyzer such as Beltronics' Swing Mate. Also, the amount of strain a golfer puts on a shaft of a golf club may be determined by a flex analyzer such as the Mizuno Flex Analyzer. Typically, the flex analyzer is a driver club that has a strain gauge attached to a shaft and some electronics that display a number based upon how much strain a golfer puts on the shaft. This number ranges from 1 to 7 and indicates a relative tempo. For example, a high tempo golfer generally makes a very fast transition from backswing to downswing which strains the shaft more than someone with a slow tempo or a smooth transition.

Figure 7:
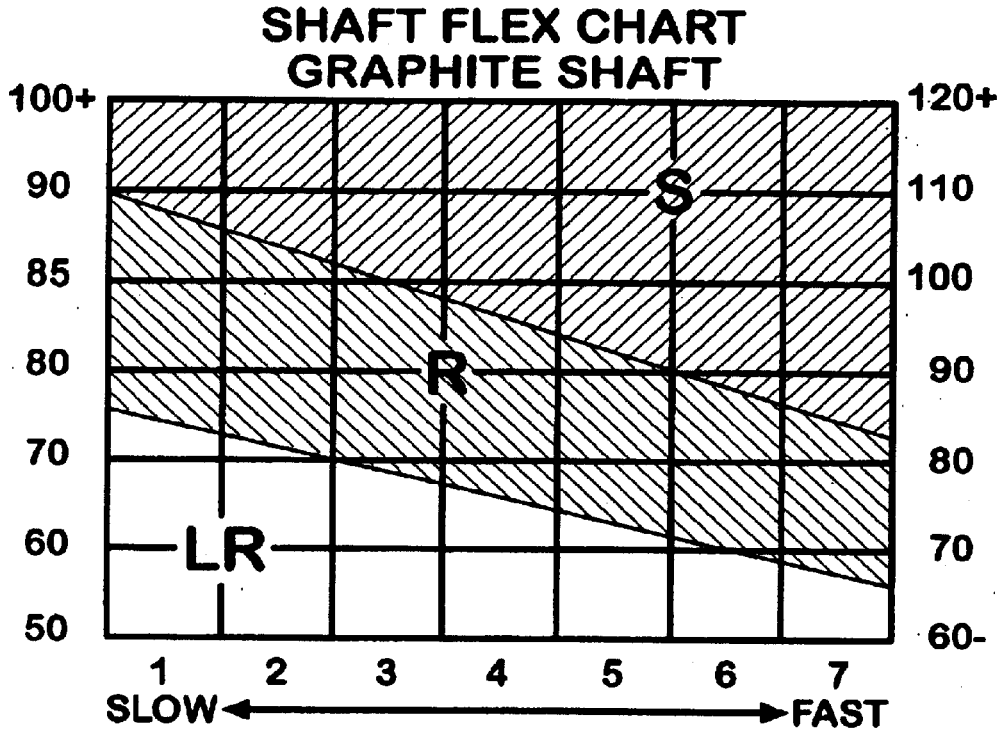
FIG. 7 is a shaft flex chart for graphite shafts.
Figure 8:
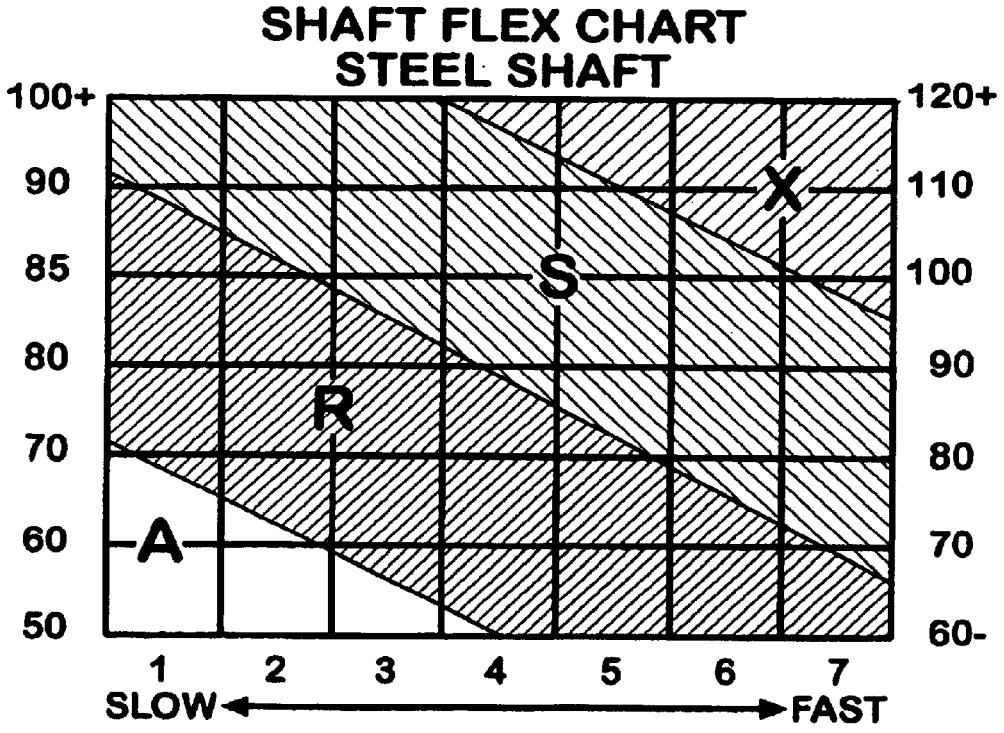
FIG. 8 is a shaft flex chart for steel shafts.

Once the swing speed and the relative tempo are determined, the golfer may use the shaft flex charts depicted in FIGS. 7 and 8 for graphite and steel shafts, respectively. The left side of each chart indicates the possible swing speed in miles per hour when utilizing a 6-iron. The rights side of each chart indicates the possible swing speeds in miles per hour when utilizing a driver. For example, a golfer swinging a driver with a swing speed over 100 miles per hour would want a graphite shaft for a custom driver to have a shaft flex of "S" for stiff. The shaft flex "X" indicates an extra stiff shaft, the shaft flex "R" indicates a regular stiffness, the shaft flex "LR" indicates a light regular flex, and the "A" shaft flex indicates a senior flex.

The use of the golf head club 10 as described above constitutes an inventive method of the present invention in addition to the golf club head 10 itself. In practicing the method of determining at least one fitted golf club for a golfer with a trial golf club having the golf club head 10, the steps include swinging the trial golf club as to contact a golf ball on the ground. In response to swinging the trial golf club, the method then includes the step of impacting the ground with a sole 28 of the golf club head 10. The next step includes locating the point of impact on the sole 28 of the club head 10. The invention also includes identifying the optimal lie angle of a fitted golf club from said point of impact as described above.

This method may also include the step of identifying the optimal shaft length of the fitted golf club by measuring the golfers grip along the length of a shaft of the trial golf club. Alternatively, the method may include the step of determining the optimal shaft length of the fitted golf club by measuring the distance between the ground and the golfer's knuckles as described above. This invention may also include the step of identifying the optimal shaft flex by measuring the speed and tempo of the golfer's swing as described above. Next, the method may also include the step of identifying the optimal grip size by assessing the extent which the two middle fingers 50 contact the heel portion 52 of the golfer's palm as the golfer grasps a grip as described above.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A trial golf club for determining at least one fitted golf club, said trial club comprising an iron golf club head comprising:

a sole defined by a radius of curvature and having graduated, indicia the graduated indicia comprising a plurality of equally spaced apart markings on said sole extending substantially from a toe to a heel of said sole of said iron golf club head, said equally spaced apart markings operable for identifying an optimal lie angle for the fitted club when a golfer swings said trial golf club to contact a golf ball by locating the point of impact of the ground with said sole of said iron golf club head of said trial golf club, wherein the radius of curvature of said sale of said iron golf club head from the toe portion to the heel portion is approximately 400 mm and is correlated to the equally spaced apart markings corresponding with a range of possible lie angles in two degree increments.

2. The trial golf club of claim 1 wherein at least a portion of said equally spaced apart markings of said plurality of said equally spaced apart markings are spaced approximately 0.5 inches apart from one another and identify a particular lie angle.

3. The trial golf club of claim 1 further comprising a shaft having a grip, said grip having graduated indicia along a portion of the length of said grip for facilitating the identification of the optimal length of the shaft of the erred golf club.

4. The trial golf club of claim 1, wherein the iron golf club head further comprises a back, comprising a plurality of marking, wherein each marking is associated with at least one of the graduated indicia on the sole to identify the lie angle when she iron golf club head impacts the ground.

5. A trial golf club for determining at least one fitted golf club, said trial golf club comprising:

a first set of graduated indicia along a portion of the length of said golf club grip of the trial golf club for facilitating the identification of the optimal length of a golf club shaft of the fitted golf club;

a second set of graduated indicia on a sole of an iron golf club head of the trial golf club comprising a plurality of equally spaced apart markings extending substantially from a toe to a heel of said sole of said golf club, said plurality of equally spaced apart markings on said sole of said golf club head operable for identifying an optimal lie angle for the fined club, when a golfer swings said trial golf club to contact a golf ball, by locating the point of impact of the ground with at least one equally spaced apart marking on said sale of said golf club head of said trial golf club, wherein the radius of curvature of the sole of the iron golf club head from the toe to the heel is approximately 400 mm and is correlated to the equally spaced apart markings corresponding with a range of possible lie angles in two degree increments.

6. The trial golf club of claim 5 wherein said second set of indicia on said sole of said golf club head of said trial golf club identify particular lie angles.

7. The trial golf club of claim 6 wherein said second set of indicia comprises a plurality of equally spaced apart markings, at least a portion of said equally spaced apart markings are spaced at intervals of approximately 0.5 inches for identifying consecutive lie angles in two degree increments.

8. The trial golf club of claim 5, wherein the iron golf club head further comprises a back, comprising a plurality of markings, wherein each marking is associated with at least one of the graduated indicia on the sole to identify the lie angle when the iron golf club head impacts the ground.

9. A method for determining at least one fitted iron golf club for a golfer, comprising the steps of:

identifying an optimal shaft length for the fitted golf club;

identifying at least one equally-spaced indicia along a portion of a length of a golf grip on a trial golf club associated with the optimal shaft length, the grip comprising a plurality of equally-spaced indicia having said golfer grip said golf grip at the at least one equally-spaced indicia associated with the optimal shah length;

swinging said trial golf club as to contact a golf ball on the ground;

in response to swinging said trial golf club, impacting the ground with a sole of a golf club head of said trial golf club, said sole defined by a radius of curvature of 400 mm extending from the toe to the heel and having equally spaced apart indicia corresponding with a range of possible lie angles in two degree increments for the trial golf club, wherein the radius of approximately 400 mm is correlated to the equally spaced apart markings;

locating the point, of impact on said sole of said golf club head of said trial golf club; and identifying the optimal lie angle of the lined golf club from said point of impact on said sole of said golf club head.

10. The method of claim 9 further comprising determining the optimal shaft length of the fitted golf club by measuring the distance between the ground and the golfer's knuckles when making a fist; and associating the optimal shaft length to at least one of the plurality of equally spaced indicia on the golf grip prior to having said golfer grip said trial golf club.

11. The method of claim 9 further comprising the step of identifying the optimal shaft flex by measuring the speed of the golfer's swing.

12. The method of claim 9 further comprising the step of identifying the optimal grip size by assessing the extent which the two middle fingers contact the heel portion of the golfers palm as the golfer grasps a grip of a golf club.

13. The method of claim 9, wherein she iron golf dub head further comprises a back comprising a plurality of markings, wherein each marking is associated with at least one of the graduated indicia on the sole to identify the lie angle when the won golf club head impacts the ground.

14. A method for determining at least one fitted golf club for a golfer, comprising the steps of:

determining the optimal shaft length of the fitted golf club by measuring the distance between the ground and the golfer's knuckles when making a fist;

gripping a trial golf club comprising a grip comprising a plurality of markings corresponding, wherein at least one marking corresponds to the determined optimal shaft length, such that the golfer's hands are positioned at the at least one marking corresponding to the determined optimal shaft length;

identifying the optimal shaft flex by measuring the speed of the golfer's swing when the golfer swings said trial golf club;

swinging said trial golf club as to contact a golf ball on the ground;

an response to swinging said trial golf club, impacting the ground with a sole of an iron golf club head of said trial golf club, said sole defined a radius of curvature of approximately 400 mm extending from a toe portion of the iron golf club head to a heel portion of the iron golf club head and having a plurality of markings, wherein each marking corresponds to consecutive lie angles of approximately two degrees for the fitted golf club;

locating at least on mark closest to the point of impact on said sole of said head of said trial golf club;

identifying the optimal lie angle corresponding to the mark closest to the point of impact of a fitted golf club from said point of impact; and identifying the optimal grip size by assessing the extent which the two middle fingers contact the heel portion of the golfer's palm as the golfer grasps a grip of a golf club.

15. The method of claim 14 further comprising the step of manufacturing the fined golf club to have said optimal shaft length, optimal shaft flex, optimal lie angle, and optimal grip size.

16. The method of claim 14, wherein the iron golf club head further comprises a back, comprising a plurality of markings, wherein each marking is associated with at least one of the graduated indicia on the sole to identify the lie angle when the iron golf club head impacts she ground.

* * * * *